US007213501B2

(12) United States Patent
Kauss et al.

(10) Patent No.: US 7,213,501 B2
(45) Date of Patent: May 8, 2007

(54) HYDRAULIC CONTROL ARRANGEMENT

(75) Inventors: Wolfgang Kauss, Francheville (FR); Didier Desseux, Solaize (FR)

(73) Assignee: Bosch Rexroth AG, Stuttgart (DE)

( * ) Notice: Subject to any disclaimer, the term of this patent is extended or adjusted under 35 U.S.C. 154(b) by 0 days.

(21) Appl. No.: 10/558,836

(22) PCT Filed: May 28, 2004

(86) PCT No.: PCT/EP2004/005836

§ 371 (c)(1),
(2), (4) Date: Jan. 23, 2006

(87) PCT Pub. No.: WO2004/109123

PCT Pub. Date: Dec. 16, 2004

(65) Prior Publication Data

US 2006/0150807 A1 Jul. 13, 2006

(30) Foreign Application Priority Data

Jun. 4, 2003 (DE) ..... 103 25 294

(51) Int. Cl.
*F15B 13/04* (2006.01)

(52) U.S. Cl. ..... 91/447; 137/625.69

(58) Field of Classification Search ..... 91/444, 91/445, 446, 447, 448; 137/596, 596.13, 137/625.69

See application file for complete search history.

(56) References Cited

U.S. PATENT DOCUMENTS 3,125,120 A 3/1964 Hasbany
3,595,271 A 7/1971 Nelson
4,782,859 A * 11/1988 Constantinian ..... 91/447
6,256,986 B1 7/2001 Langen et al.

FOREIGN PATENT DOCUMENTS

| | | | |
|---|---|---|---|
| DE | WO 95/32364 | A1 | 11/1995 |
| DE | 196 27 306 | A1 | 1/1998 |
| DE | 100 01 665 | A1 | 7/2001 |
| DE | 40 28 887 | C2 | 8/2003 |
| FR | 2 756 349 | A1 | 5/1998 |

OTHER PUBLICATIONS

Data sheet RE 64 284/06.00; "High pressure LUDV load-sensing control block of monoblock/sandwich plate design Type M6-15"; Rexroth Hydraulics.

* cited by examiner

*Primary Examiner*—Michael Leslie
(74) *Attorney, Agent, or Firm*—Oliff & Berridge, PLC

(57) ABSTRACT

A hydraulic control arrangement is disclosed for the load pressure independent control of a consumer, comprising a distribution valve forming an inlet metering orifice, a corresponding individual pressure compensator, a stop valve provided for each consumer connection which may be released by means of a pilot valve and an anti-cavitation valve by means of which pressure medium can be drawn from a reservoir to avoid cavitation. According to the invention, the distribution valve and the stop valves are arranged along two parallel axes, while the axes of the two pilot valves are arranged perpendicularly to these two axes. The anti-cavitation valves in turn extend perpendicularly to the axes of the distribution valves, the stop valves and the anti-cavitation valves.

10 Claims, 4 Drawing Sheets

HYDRAULIC CONTROL ARRANGEMENT

The invention relates to a hydraulic control arrangement for the load-independent control of a consumer in accordance with the preamble of claim 1.

The basic structure of such a control arrangement is known, for instance, from WO 95/32364 A1. In this load pressure-independent flow distribution (LUDV)[1] system each consumer is provided with an adjustable metering orifice including a pressure compensator down the line, the latter keeping the pressure drop above the metering orifice constant so that the amount of pressure medium flowing to the respective hydraulic consumer is solely dependent on the opening cross-section of the metering orifice and not on the load pressure of the consumer or on the pump pressure. Since, for instance, in mobile working implements a plurality of such valve arrangements are connected in parallel, it is achieved by the pressure compensators of the system that, in the case that a hydro pump of the system has been adjusted up to the maximum stroke volume and the pressure medium flow is not sufficient to maintain the predetermined pressure drop above the metering orifices of the respective valve arrangements allocated to a consumer, the pressure compensators of all operated hydraulic consumers are adjusted in the closing direction so that all pressure medium flows are reduced by the same percentage. Due to this load-pressure independent flow distribution (LUDV) then all operated consumers move at a velocity reduced by the same percentage value. In the known solution it may occur when a consumer is supported for a quite long time that it drops due to a leakage flow via the distribution valve.

[1]German abbreviation (lastdruckunabhängige Durchflussverteilung)

This drawback is eliminated in a solution according to the data sheet RD 64 284/06.00 (hydro valves for mobile applications) by a releasable check valve which is inserted in the pressure medium flow path between the distribution valve and a consumer connection and which ensures the oil-leakage free shut-off thereof. In this known solution moreover a pressure/feed valve by which the consumer is protected against overload and against cavitation phenomena in the case of a lacking supply of the corresponding consumer connection with pressure medium.

In the solution known from FR 2,756 349 to each consumer connection a suction valve is allocated which extends perpendicularly to the plane of a valve disk accommodating the valve arrangement. This known solution lacks a stop valve for oil-leakage free shut-off of the consumer, however.

Compared to this, the object underlying the invention is to provide a hydraulic control arrangement in which all components required for controlling the consumer are combined in a compact manner in a valve housing portion, preferably a valve disk.

This object is achieved by a hydraulic control arrangement comprising the features of claim 1.

In accordance with the invention, the control arrangement is preferably integrated in a valve disk, wherein a distribution valve forming a LUDV metering orifice as well as two stop valves allocated to a consumer connection are located in the valve disk plane and two pilot valves allocated to the two stop valves are incorporated such that the axes thereof are oriented perpendicularly to the two axes of the distribution valve and of the stop valves. The pressure/anti-cavitation valve allocated to a consumer connection is arranged perpendicularly to the axes of the afore-described valve elements, i.e. perpendicularly to the disk plane. Moreover it is a particular feature of the invention that the pilot valves arranged perpendicularly to the axis of the distribution valve are actuated mechanically via a tappet which is axially movable by a slide valve of the distribution valve so as to release the stop valves and to permit discharge of pressure medium from the consumer.

The solution according to the invention excels by a special compactness, wherein all substantial components required in a LUDV system are accommodated in a minimum construction space.

Solutions in which the pilot valve is actuated mechanically via the slide valve of the distribution valve are known as such for instance from DE 196 27 306 A1 or U.S. Pat. No. 3,595,271 or U.S. Pat. No. 3,125,120. But these documents include no information about the compact structure according to the invention of a valve disk for a LUDV system.

In a preferred embodiment of the invention the distribution valve, the stop valves and the pilot valves are arranged in parallel to the disk plane (FIG. 1) and the anti-cavitation valve is arranged perpendicularly to the disk plane so that the valve disk can be manufactured with a minimum effort due to the simple passage guiding.

In this variant it is preferred when also the axis of the LUDV pressure compensator downstream of the metering orifice of the distribution valve extends in the disk plane.

In an embodiment having a particularly compact design the axis of the individual pressure compensator is arranged centrally between the axes of the two pilot valves so that the valve disk has an almost axially symmetrical structure.

In this variant it is preferred when the axis of the two anti-cavitation valves is arranged in the area which is encompassed by the axis of the two stop valves, the two axes of the pilot valves and the axis of the distribution valve.

For actuating the pilot valve the slide valve of the distribution valve has an operating portion by which a tappet guided perpendicularly to the distribution valve axis is axially movable for controlling the pilot valve to be opened. In a preferred embodiment of the invention this tappet is guided in a portion of the valve disk or the valve housing.

In a particularly compact embodiment the axis of the pilot valve intersects the axis of the respective allocated stop valve.

The mounting of the anti-cavitation valves is especially simple when in the area of these anti-cavitation valves working passages leading to the consumer connections are located in a plane which is arranged offset with respect to a plane of the valve disk including a reservoir passage.

Other advantageous further developments of the invention constitute the subject matter of further subclaims.

Hereinafter a preferred embodiment of the invention will be illustrated in detail by way of schematic drawings in which.

Figure 1:
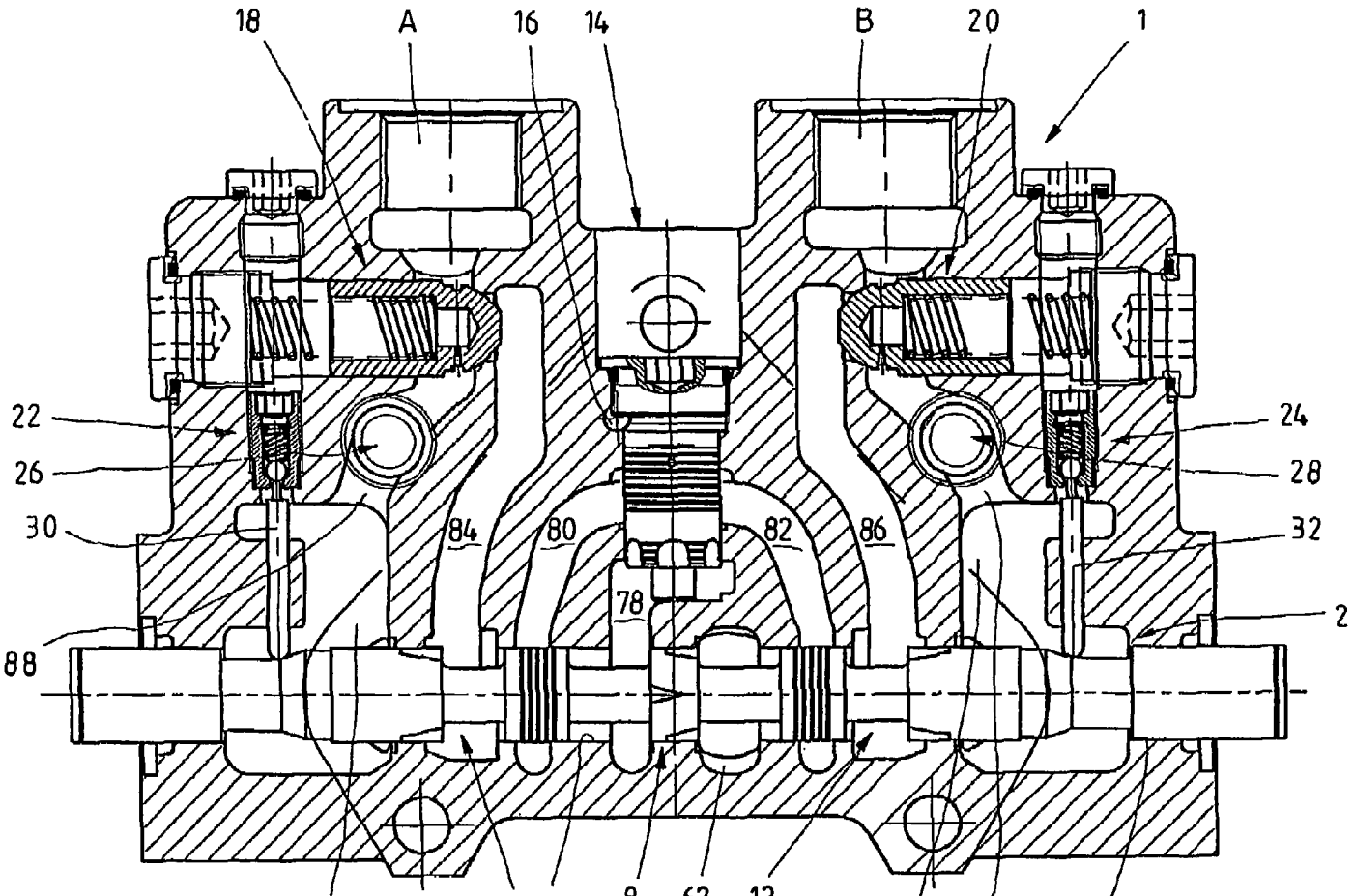
FIG. 1 shows a schematic sectional view of a valve disk comprising the control arrangement according to the invention.

FIG. 1 shows a section across a valve disk 1 of a control block of a mobile working implement, for instance a dipper dredger, wherein the valve elements for each function (for example traveling drive, lifting/lowering, operating the shovel etc.) are each combined in a valve disk. The valve disk 1 shown in FIG. 1 has two consumer connections A, B and a pressure connection P (not shown), a reservoir connection T (not shown) as well as plural control connections (inter alia an LS connection). In the valve disk 1 a continuously variable distribution valve 2 is provided including a slide valve 4 which is guided to be axially movable in an axial bore 6 passing through the valve disk 1 in the transverse direction. As explained in more detail hereinafter, the slide valve 4 together with the axial bore 6 forms a velocity member, which is also referred to as metering orifice 8, and two directional members 10, 12 via which the direction of the pressure medium flow from and to the consumer connections A, B is defined.

Downstream of the metering orifice an individual pressure compensator 14 (LUDV pressure compensator) is provided to which in the opening direction the pressure downstream of the metering orifice 8 is applied and in the closing direction the force of a not shown control spring and the maximum load pressure of the consumers is applied. This load pressure is tapped off via a load pressure detecting line 16 and is signaled to the spring chamber of the pressure compensator. Under certain circumstances the control spring can also be dispensed with.

In the valve disk 1 moreover two stop valves 18, 20 each allocated to a consumer connection A, B are arranged via which the consumer connections A, B can be shut off in an oil-leakage free manner. In order to permit a reflux each stop valve 18, 20 can be released by means of a pilot valve 22, 24. In the embodiment represented in FIG. 1 the axes of these pilot valves 22, 24 extend perpendicularly to the axis of the distribution valve 2 and the common axis of the two stop valves 18, 20, the axes of the pilot valves 22, 24 intersecting the axis of the allocated distribution valve 18 and 20, respectively. Each of the pilot valves 22, 24 is actuated via a tappet 30, 32 which is axially movable by the slide valve 4.

Perpendicularly to the plane of projection in FIG. 1, in the valve disk 1 two further pressure/anti-cavitation valves 26, 28 are inserted which control a connection to the reservoir connection T to be opened when a predetermined pressure at the consumer connection A, B is exceeded and which permit feeding of pressure medium from the reservoir in the case of a lacking supply of pressure medium. According to FIG. 1, the two axes of the pressure/anti-cavitation valves 26, 28 are located inside the area formed by the common axis of the two stop valves 18, 20, the axis of the distribution valve 2 as well as the two axes of the pilot valves 22, 24.

The individual pressure compensator 14 as well as the stop valves 18, 20, the pilot valves 22, 24 and the pressure/anti-cavitation valves 26, 28 are inserted in valve bores of the valve disk 1 which are bored from outside, i.e. from the end faces (pressure compensator, pilot valves, stop valves) or from the large area of the valve disk 1 (pressure/anti-cavitation valves) and are shut off after inserting the respective valve bodies by screw plugs or the like.

Further details of the valve arrangement will be illustrated hereinafter by way of the detailed representations.

Figure 2:
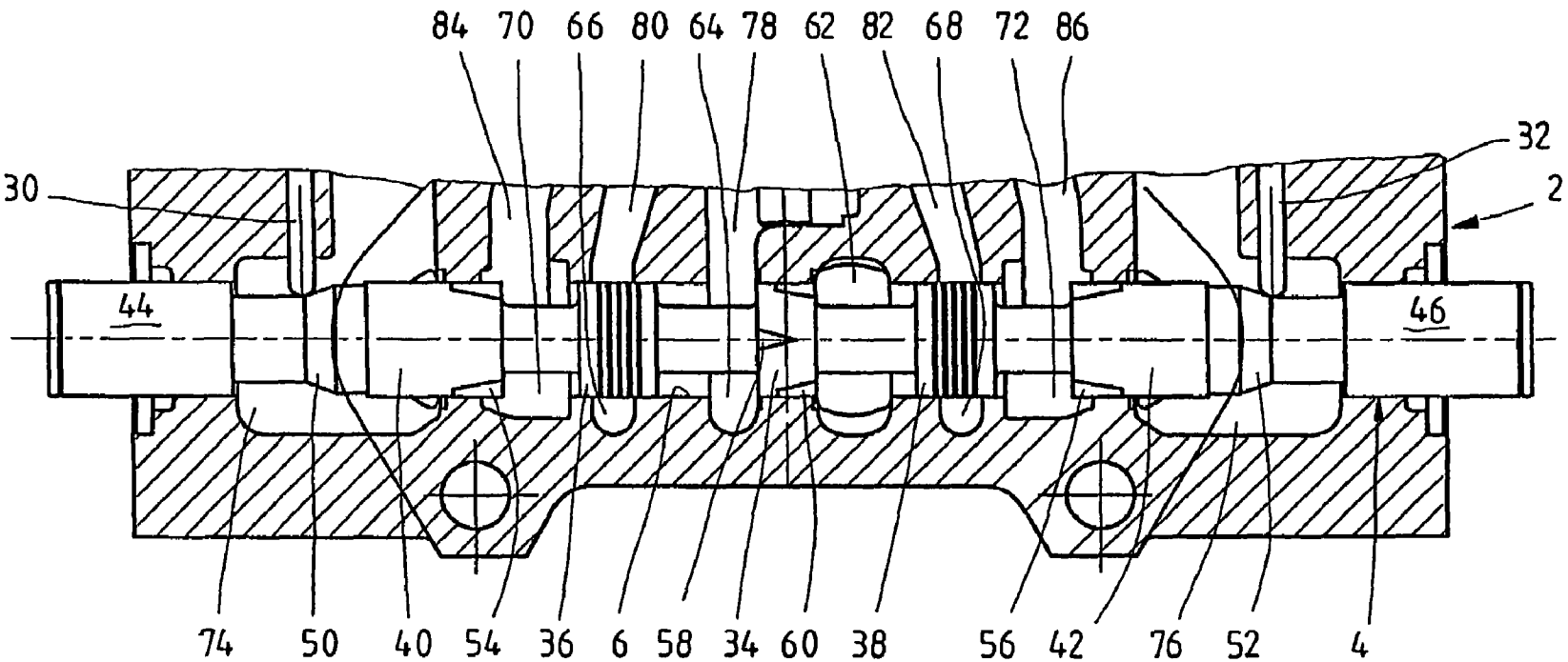
FIG. 2 shows a detailed representation of a distribution valve of the valve disk from FIG. 1.

FIG. 2 shows the distribution valve 2 of the valve disk 1.

The slide valve 4 includes a plurality of annular grooves by which it is subdivided into a central metering orifice collar 34, two control collars 36, 38 arranged on both sides thereof and two reservoir collars 40, 42 arranged laterally thereof. The two end portions 44, 46 project from the valve disk 1. In this area, housings which accommodate the centering springs for the slide valve 4 or control members are flanged to the valve disk.

The annular end faces of the two reservoir collars 40, 42 located externally in FIG. 2 are in the form of inclined control faces 50, 52 against which the tappet 30 and/or 32 is not biased in the central position of the control slide. The two other annular end faces of the reservoir collar 40, 42 are provided with control notches 54, 56. In a similar way fine control notches 58, 60 also end in the annular faces of the central metering orifice collar 34.

The non-represented pressure connection P opens into a pressure chamber 62 which is formed by an annular groove of the axial bore 6. In addition to this pressure chamber 62, the axial bore is further extended to a connecting chamber 64, two annular chambers 66, 68, two outlet chambers 70, 72 as well as two external reservoir chambers 74, 76. Between each of the aforementioned chambers there remain lands which cooperate with the control edges of the slide valve 4.

According to FIG. 1 and FIG. 2 the connecting chamber 64 opens into a pressure compensator passage 78 leading to the inlet of the individual pressure compensator 14. The outlet of the individual pressure compensator is connected to the annular chambers 66, 68 via two passages 80, 82. Each of the two outlet chambers 70, 72 opens into a consumer passage 84, 86 extending toward the inlet of the stop valves 18 and 20, respectively.

In each of the two reservoir chambers 74, 76 a reservoir chamber 88, 90 (cf. FIG. 1) opens which leads to the corresponding pressure/anti-cavitation valve 26, 28.

Figure 3:
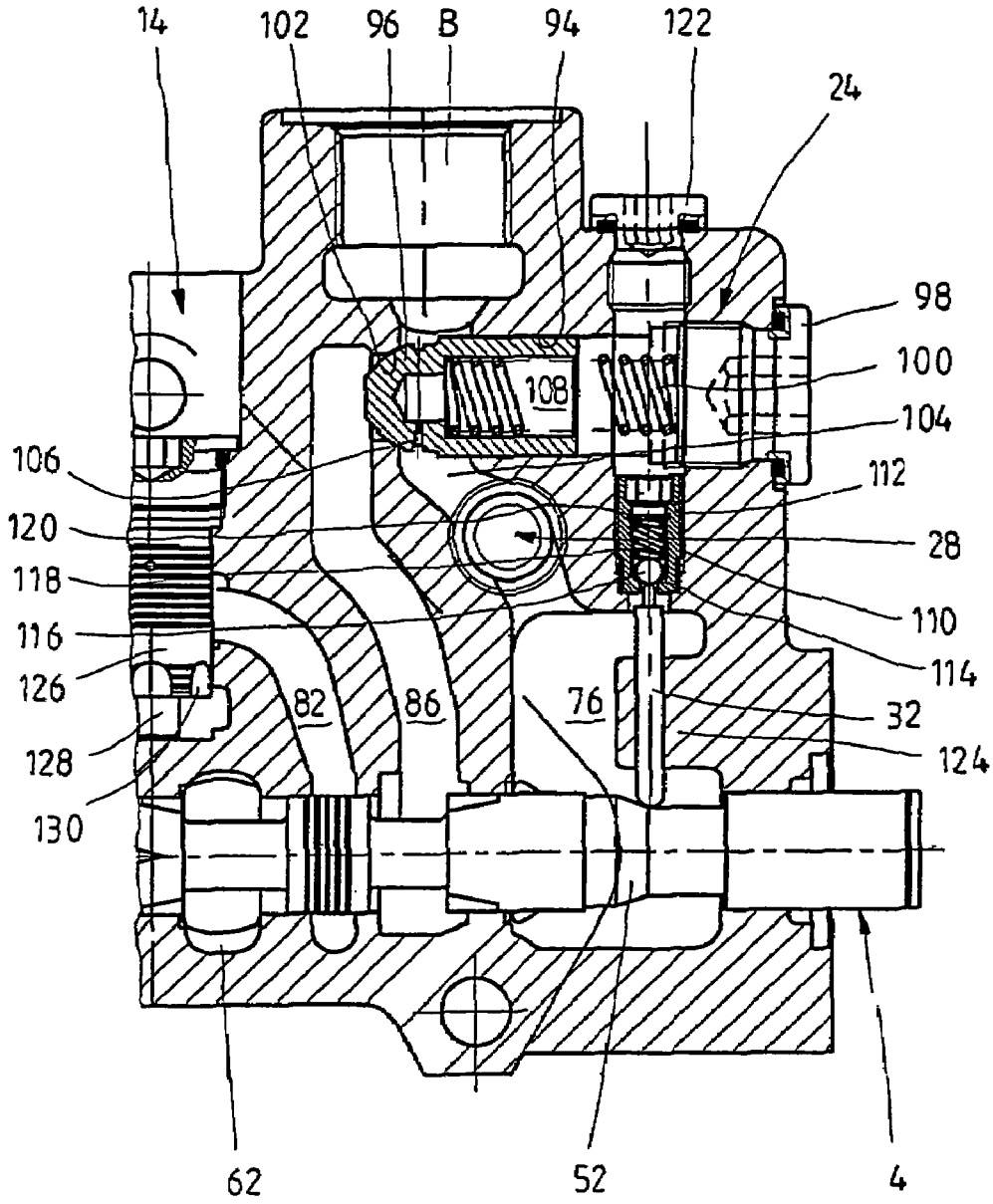
FIG. 3 is a detailed representation of a stop valve, a pilot valve and a pressure compensator of the distribution valve from FIG. 1

In FIG. 3 that part of the valve disk 1 is represented in which the stop valve 20 and the pilot valve 24 as well as a part of the individual pressure compensator 14 are housed. The stop valve 20 has a stop piston 96 which is guided to be axially movable in a stop valve bore 94. The latter is shut off by a screw plug 98 supporting a spring 100 via which the stop piston 96 is biased against a valve seat 102. The stop piston 96 is designed to have a seat difference. In the shown locking position the connection between the consumer passage 86 and a working passage 104 connected to the consumer connection B is closed.

This working passage 104 extends from the consumer connection B to the pressure/anti-cavitation valve 28.

In the shell of the stop piston 96 a nozzle 106 is provided by which a spring chamber 108 accommodating the spring 100 is connected to the operating passage 104. This spring chamber 108 can be relieved via the pilot valve 24 toward the reservoir T. The pilot valve includes a seat lining 110 inserted in a bore 112. In the valve lining 110 a pilot seat 114 is formed against which a valve body 116 is biased by means of a pilot spring 118. The latter is supported on a circlip 120 inserted in the lining 110. As one can take especially from FIG. 3, the bore 112 intersects the stop valve bore 64, wherein in the representation according to FIG. 3 the valve lining 110 is inserted with the valve body 116 and the pilot spring 118 in an area of the bore 112 which is arranged opposite to the stop valve bore 94. The opening area of the bore 112 distant from the valve lining 110 is shut off by a screw plug 112. The axis of the bore 112 extends coaxially with respect to the axis of the tappet 82 guided in a guide projection 124 of the valve disk 1. The bore 112 ends in the reservoir chamber 76 so that the end portion of the tappet 32 located on the top in FIG. 3 can dip into the opening encompassed by the pilot seat 114 and can be brought into contact with the valve body 116.

The pressure compensator piston 126 is biased with an axial projection 128 against a wall of the pressure compensator passage 78 and at the adjacent annular front includes control notches 130 constituting a control edge by which the connection between the pressure compensator passage 78 and the passages 80, 82 can be opened.

The pressure-limiting valve is a unit. The pressure spring presses on the seat element 138 and the disk 142 which is positively connected to 144 and 146.

The elements 144 and 146 are one component. The tapered end of 146 is pulled by the pressure spring to the internal seat in 138. The tapered spring 200 presses the entire unit 138 onto the seat in the housing.

Figure 4:
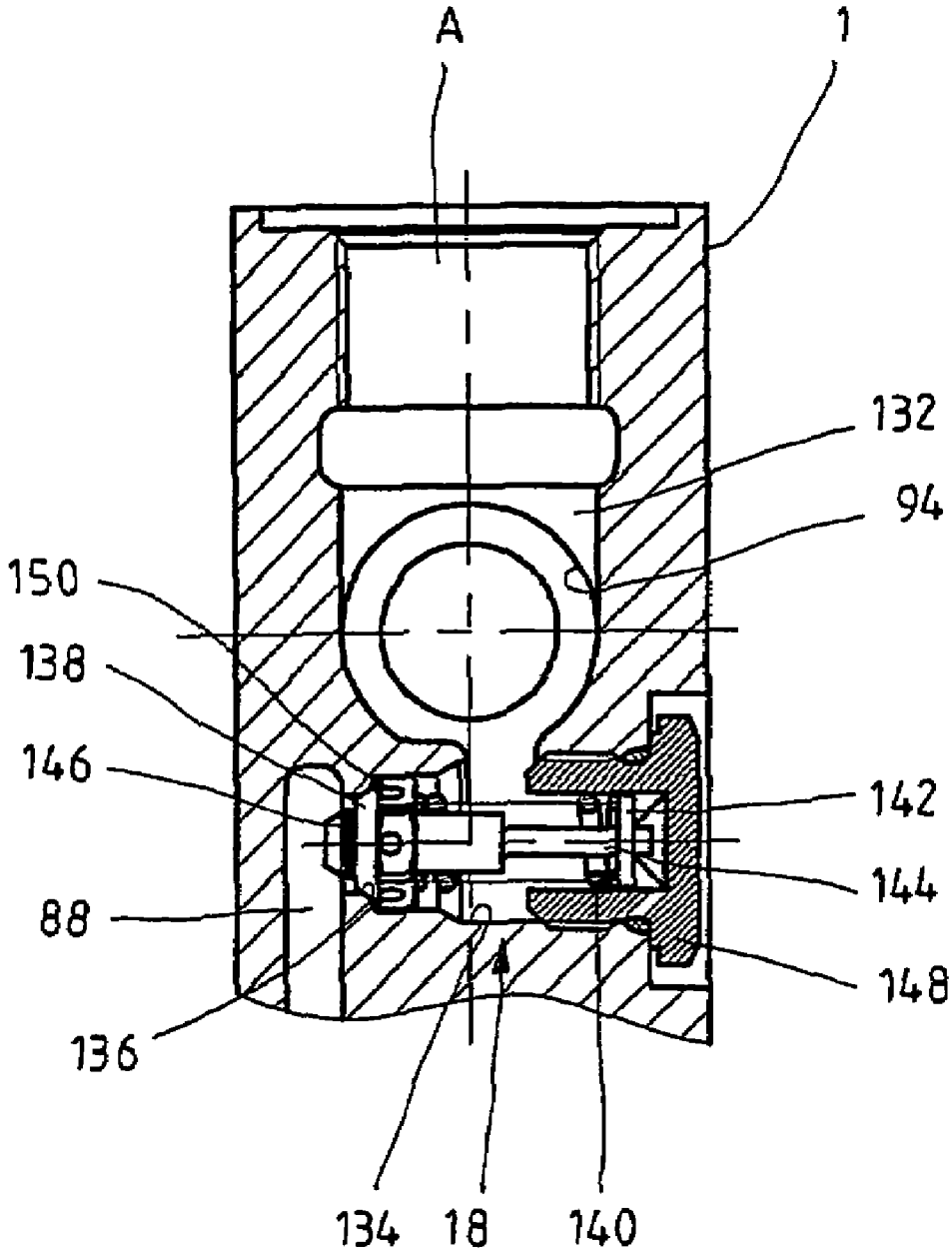
FIG. 4 is a cut side view of the valve disk from FIG. 1 including a pressure/anti-cavitation valve.

FIG. 4 shows a cut side view in the area of the pressure/anti-cavitation valve 26. The consumer connection A opens into a working passage 132. The latter (corresponding to the working passage 104 of the working connection B) leads to a radial connection of the pressure/anti-cavitation valve 18. This valve is inserted in an anti-cavitation bore 134 through which the working passage 132 can be connected to the reservoir passage 88. By the anti-cavitation bore 134 an anti-cavitation valve seat 136 is formed against which an anti-cavitation cone 138 is biased via a pressure spring 140. This spring is supported on a spring plate 142 which, in turn, is mounted on a piston rod 144 of a pressure-limiting piston 146 guided in the anti-cavitation cone 138. The piston rod 144 including the spring plate 142 is supported on a supporting screw 148 which is screwed into the anti-cavitation bore 134 from a large area of the valve disk 1. In the anti-cavitation cone 138 a seat for the pressure-limiting piston 146 is provided against which the latter is biased by the force of the pressure spring 140. The pressure in the spring chamber of the pressure/anti-cavitation valve 26 is signaled to the seat for the pressure-limiting piston 146 via pressure bores 150 of the anti-cavitation cone 138. When a predetermined maximum pressure is exceeded in the working passage 132, the pressure-limiting piston 146 lifts off the seat against the force of the pressure spring 140 and against the pressure acting on the pressure-limiting piston 146 in the reservoir passage 88 to the left (FIG. 4) so that pressure medium can flow from the working passage 132 into the reservoir passage 88—the pressure in the working passage 132 thus being restricted to the maximum value. In the case of a lacking supply, in the reservoir passage 88 a higher pressure is prevailing than in the working passage 132 so that the anti-cavitation cone 138 can lift off its anti-cavitation valve seat 136 against the force of the pressure spring so that pressure medium can flow from the reservoir into the working passage 132, sufficient supply with pressure medium is ensured and cavitation cannot occur.

The structure according to the invention having a design symmetrical in the representation according to FIG. 1 with respect to the axis of the individual pressure compensator 14 and the intersecting axes of the stop valve 18, 20 and the allocated pilot valve 22, 24 and the pressure/anti-cavitation valves 26, 28 arranged perpendicularly thereto permits to combine all hydraulic components required for a LUDV control and a leakage-free support of a consumer in a minimum space.

For a better comprehension of the invention, hereinafter the function of the control arrangement 1 according to the invention will be briefly explained. It is assumed that the slide valve 4 of the distribution valve 2 is moved to the right in the representation according to FIG. 1 so as to pass pressure medium via the consumer connection A to the consumer and from the latter via the consumer connection B back to the reservoir T. By the axial displacement of the slide valve 4 to the right a metering orifice cross-section is controlled to be opened via the control notches 58 of the metering orifice collar 34 so that pressure medium can flow from the pressure chamber 62 into the pressure compensator passage 78. With a sufficient pump pressure the pressure compensator is moved to an opening position by the pressure effective in the opening direction so that the pressure medium can flow via the passage 80 and the annular chamber 66 into the opened outlet chamber 70. From there the pressure medium passes via the consumer passage 84 to the inlet of the stop valve 18. With a sufficient pressure in the consumer passage 84 the stop piston 96 of the stop valve 18 is lifted off its valve seat 102 against the force of the spring 100 so that the pressure medium is supplied toward the consumer A. The load pressure building up at the consumer is signaled via the LS passage 74 to the spring chamber of the individual pressure compensator 14. This compensator adjusts a control position in which the pressure drop is kept constant above the inlet metering orifice.

At the same time, the tappet 32 is displaced upwards via the control surface 52 in the axial direction (view according to FIG. 1) by the axial movement of the slide valve 4 to the right so that the valve body 116 is lifted off its pilot seat 114 and the spring chamber 108 of the stop valve is correspondingly relieved toward the reservoir chamber 76. The pressure prevailing at the working connection B then suffices to lift the stop piston 96 off its valve seat 102 against the force of the spring 100 so that the pressure medium can flow from the working connection B via the consumer passage 86 and the discharge cross-section opened by the reservoir collar 42 including the control notches 56 into the reservoir chamber 76 and from there to the reservoir.

In the event in which a pulling load occurs (for instance when pouring out or lowering a load) it may happen that not sufficient pressure medium is fed to the working connection A so that the pressure at this connection falls below the pressure in the outlet. In other words, the inlet pressure falls below the reservoir pressure so that the pressure/anti-cavitation valve is opened in the above-described manner and pressure medium can continue to flow from the reservoir passage 88 into the working passage 132.

A hydraulic control arrangement is disclosed for the load pressure independent control of a consumer, comprising a distribution valve forming an inlet metering orifice, a corresponding individual pressure compensator, a stop valve provided for each consumer connection which may be released by means of a pilot valve and an anti-cavitation valve by means of which pressure medium can be drawn from a reservoir to avoid cavitation. According to the invention, the distribution valve and the stop valves are arranged along two parallel axes, while the axes of the two pilot valves are arranged perpendicularly to these two axes. The anti-cavitation valves in turn extend perpendicularly to the axes of the distribution valves, the stop valves and the anti-cavitation valves.

LIST OF REFERENCE NUMERALS

1 Valve disk
2 distribution valve
4 slide valve
6 axial bore
8 metering orifice
10 directional member
12 directional member
14 individual pressure compensator
16 LS passage
18 stop valve
20 stop valve
22 pilot valve
24 pilot valve
26 pressure/anti-cavitation valve
28 pressure/anti-cavitation valve

30 tappet
32 tappet
34 metering orifice collar
36 control collar
38 control collar
40 reservoir collar
42 reservoir collar
44 end portion
46 end portion
50 control surface
52 control surface
54 control notch
56 control notch
58 fine control notch
60 fine control notch
62 pressure chamber
64 connecting chamber
66 annular chamber
68 annular chamber
70 outlet chamber
72 outlet chamber
74 reservoir chamber
76 reservoir chamber
78 pressure compensator passage
80 passage
82 passage
84 consumer passage
86 consumer passage
88 reservoir passage
90 reservoir passage
94 stop valve bore
96 stop piston
98 screw plug
100 spring
102 valve seat
104 working passage
106 nozzle
108 spring chamber
110 valve lining
112 bore
114 pilot seat
116 valve body
118 pilot spring
120 circlip
122 screw plug
124 guide projection
126 pressure compensator piston
128 axial projection
130 control notches
132 working passage
134 anti-cavitation bore
136 anti-cavitation valve seat
138 anti-cavitation cone
140 pressure spring
142 spring plate
144 piston rod
146 pressure limiting piston
148 supporting screw
150 pressure bores

The invention claimed is:

1. A hydraulic control arrangement for the load pressure independent control of a consumer, comprising:

a housing portion having a consumer connection, in which a continuously variable distribution valve controlling a pressure medium flow to the consumer is accommodated, an individual pressure compensator being allocated to the distribution valve;

a stop valve which is arranged in a path of the pressure medium flow between the distribution valve and the consumer and can be released to permit a pressure medium flow from the consumer connection;

a pressure limiting and anti-cavitation valve via which pressure medium can be sucked from a reservoir in case of a lacking supply of the consumer, characterized in that the stop valve is controlled by a pilot valve, an axis of which extends perpendicularly to an axis of the distribution valve and of the stop valve arranged axially parallel thereto, wherein the pilot valve can be controlled to be opened mechanically by a valve spool of the distribution valve, and that an axis of the pressure-limiting and anti-cavitation valve extends perpendicularly to the axes of the distribution valve and pilot valve.

2. The hydraulic control arrangement according to claim 1, wherein the valve spool includes a control surface via which a tappet extending perpendicularly to the axis of the distribution valve is axially movable for opening the pilot valve.

3. The hydraulic control arrangement according to claim 1, wherein the control arrangement is accommodated in a valve disk and the distribution valve, the control arrangement includes two consumer connections, two stop valves, two pressure-limiting and anti-cavitation valves and two pilot valves, the two stop valves and the two pilot valves are arranged in a disk plane and the two pressure-limiting and anti-cavitation valves are arranged perpendicularly to the disk plane.

4. The hydraulic control arrangement according to claim 3, wherein an axis of the individual pressure compensator is arranged perpendicularly to the axis of the distribution valve in the disk plane.

5. The hydraulic control arrangement according to claim 4, wherein the axis of the individual pressure compensator is arranged centrally between the axes of the two pilot valves.

6. The hydraulic control arrangement according to claim 3, wherein the axis of one of the two pilot valves intersects the axis of a corresponding stop valve in an area of a spring chamber.

7. The hydraulic control arrangement according to claim 3, wherein the axis of the two pressure-limiting and anti-cavitation valves is located in the area between a common axis of the two stop valves and the axis of the distribution valve.

8. The hydraulic control arrangement according to claim 2, wherein the tappet is guided in the valve disk.

9. The hydraulic control arrangement according to claim 3, wherein each of the stop valves and the pilot valves are accommodated in intersecting bores ending at the side faces of the valve disk.

10. The hydraulic control arrangement according to claim 3, wherein at least in an area of the two pressure-limiting and anti-cavitation valves working passages leading to the two consumer connections are located in a plane of the valve disk which is arranged offset with respect to a plane including reservoir passages.

* * * * *